United States Patent [19]

Clifton et al.

[11] Patent Number: 4,909,002

[45] Date of Patent: Mar. 20, 1990

[54] CONCRETE SCREED RAILS

[75] Inventors: Roy A. Clifton, Hove; Terry J. Stoner, Lancing, both of England

[73] Assignee: Cliffston Products Limited, Brighton, England

[21] Appl. No.: 290,256

[22] Filed: Dec. 27, 1988

Related U.S. Application Data

[63] Continuation-in-part of Ser. No. 185,834, Apr. 25, 1988, abandoned.

[30] Foreign Application Priority Data

Apr. 27, 1987 [GB] United Kingdom ..... 8709877

[51] Int. Cl.[4] ..... E04B 1/00

[52] U.S. Cl. ..... 52/100; 52/364; 52/723; 404/119

[58] Field of Search ..... 52/98–100, 52/364–367, 723, 729, 318; 404/118, 119

[56] References Cited

U.S. PATENT DOCUMENTS

| | | | |
|---|---|---|---|
| 742,943 | 11/1903 | Wight | 52/261 |
| 1,648,387 | 11/1927 | Gustaveson et al. | 52/372 |
| 1,761,250 | 6/1930 | Baltes | 96/29 |
| 1,764,134 | 6/1930 | Young | 52/100 |
| 1,852,274 | 4/1932 | Thurn | 52/663 |
| 2,116,457 | 5/1938 | Whitmarsh | 52/303 |
| 2,640,248 | 6/1953 | Saffert | 249/96 |
| 2,836,529 | 5/1958 | Morris | 52/309.16 |
| 3,698,963 | 10/1972 | Nunes et al. | 428/685 |
| 4,005,560 | 2/1977 | Simpson et al. | 52/712 |
| 4,565,840 | 1/1986 | Kobayashi et al. | 52/659 |
| 4,707,955 | 11/1987 | Clapson | 52/98 |

FOREIGN PATENT DOCUMENTS

| | | | |
|---|---|---|---|
| 711590 | 6/1965 | Canada | 52/737 |
| 124532 | 1/1984 | European Pat. Off. . | |
| 168205 | 1/1986 | European Pat. Off. . | |
| 820068 | 11/1951 | Fed. Rep. of Germany | 52/368 |
| 3405187 | 5/1985 | Fed. Rep. of Germany . | |
| 824751 | 11/1937 | France | 404/50 |
| 8102600 | 9/1981 | PCT Int'l Appl. . | |
| 8400044 | 1/1984 | PCT Int'l Appl. . | |
| 435642 | 10/1967 | Switzerland | 52/252 |
| 480259 | 3/1938 | United Kingdom . | |
| 2161191 | 1/1986 | United Kingdom . | |

OTHER PUBLICATIONS

Permaban Brochure (1983).

*Primary Examiner*—James L. Ridgill, Jr.
*Attorney, Agent, or Firm*—Leydig, Voit & Mayer

[57] ABSTRACT

A concrete screed rail having generally parallel spaced top and bottom edges, at least the upper one of which is provided with a finished surface, there being at least one and preferably a plurality of recesses in a web portion of the rail. The recesses in the web portion preferably are closed off by a thin layer of concrete, the concrete including that of said recess being reinforced by a mesh or plurality of short fibers. The screed rail may be in the form of a straight beam of I-section or alternatively of generally L-shaped cross-section. If desired, additional reinforcement may be incorporated in the rail.

16 Claims, 2 Drawing Sheets

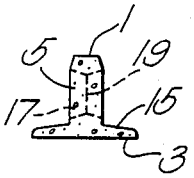
FIG. 2.
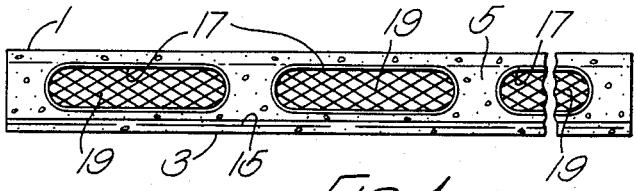
FIG. 1.
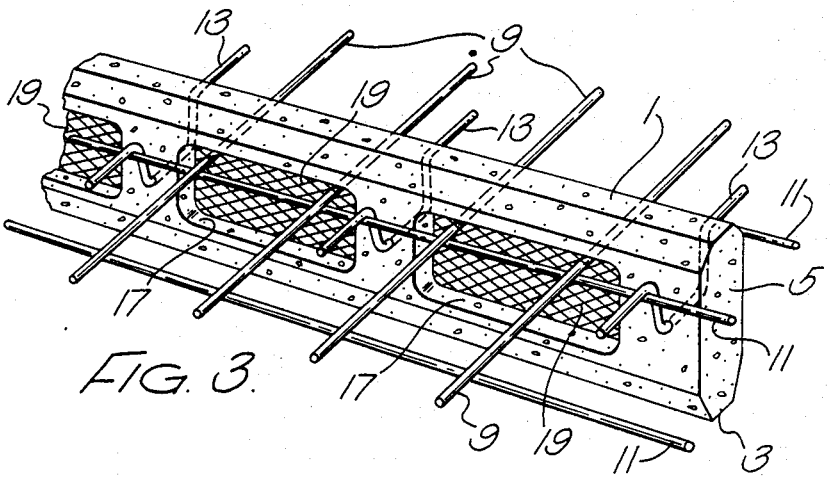
FIG. 3.
FIG. 4.
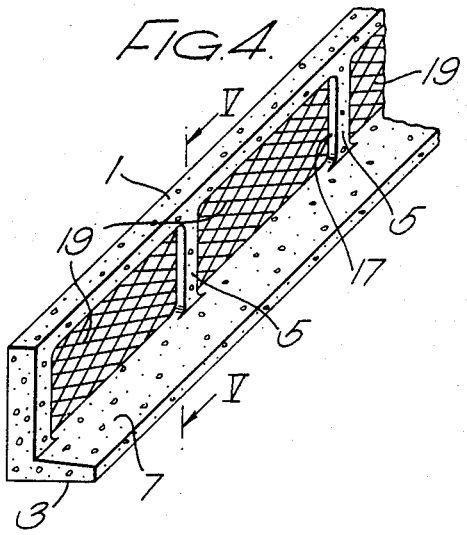
FIG. 5.
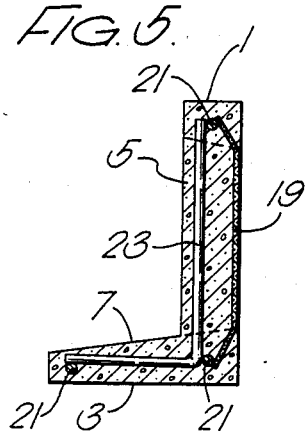

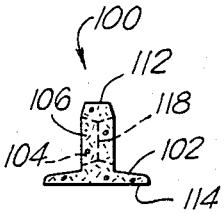
FIG. 7
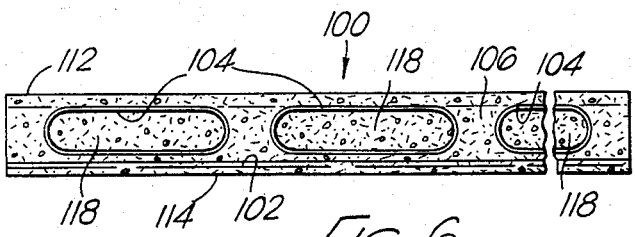
FIG. 6
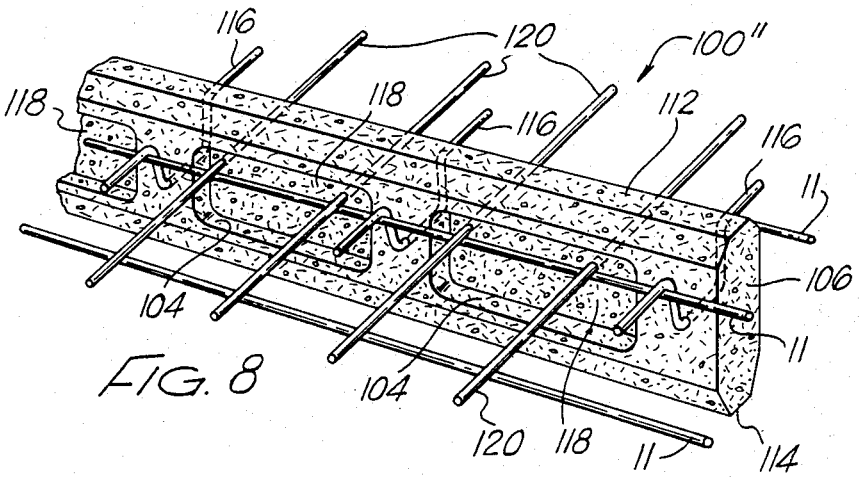
FIG. 8
FIG. 9
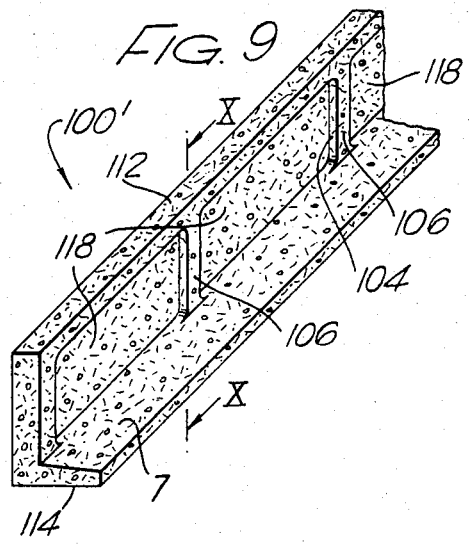
FIG. 10
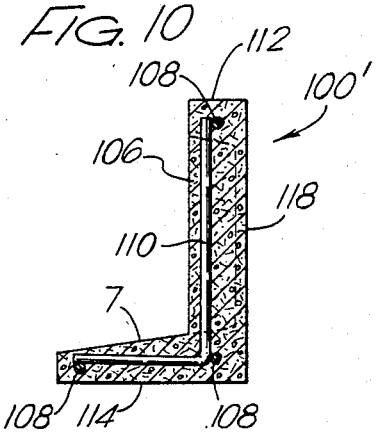

CONCRETE SCREED RAILS

CROSS REFERENCE TO RELATED APPLICATION

This application is a continuation-in-part of Ser. No. 185,834 filed Apr. 25, 1988, now abandoned.

BACKGROUND OF THE INVENTION

This invention relates to concrete screed rails, which are increasingly being accepted by the construction industry in place of traditional shuttering or formwork to assist in the placing of in situ concrete slabs and screeds.

Wooden formwork suffers from the disadvantages that it has to be sawn to size and assembled by carpenters on site, and then struck (i.e. stripped out) after a concrete pour has partly cured. It is therefore time consuming to use, and hence expensive. Furthermore, it can normally be used only once, and then becomes scrap.

The main advantage of concrete screed rails is that they are formed of the same material as the finished slab, and can therefore be left in position to form part of the slab. They also ensure that top quality concrete is provided at a slab edge, and when left in situ, they ensure a good bond with the adjacent concrete pour. Furthermore, they are easy to use, especially with reinforcement rods, and save up to 50% in time compared with timber formwork.

Concrete screed rails are already known, but these are heavy to handle and transport and are costly to transport. One known type of rail has preformed apertures in the web between the top and bottom flanges for the passage of reinforcement bars, dowels, pipework and other conduit (see EP-A-0168205 and WO/81/02600), but in practice the apertures are of the wrong size or in the wrong location. This problem is normally overcome by knocking out, with a hammer, part of the web, which will result in poured concrete leaking through the rail, and perhaps significantly weakening the rail. One version of this type of rail is known as the PERMABAN leave-in-place screed rail.

Another known concrete screed rail, the subject of EP-B-0124532, has preformed apertures in its web, and areas of reduced thickness concrete called knock-outs, which can be removed by knocking away the concrete with a hammer; again, too much concrete is usually removed, which causes leakage of poured concrete.

It has also been proposed in GB-A-480259 to produce a concrete screed rail with preformed, spaced apertures for the passage of reinforcement rods, and recesses formed in each face of the web of the rail so that it will form a key with the concrete poured on either side of the rail.

We have now developed a concrete screed rail which has all the advantages of known concrete screed rails, but does not suffer from the major disadvantages associated with such known screed rails.

SUMMARY OF THE INVENTION

According to the present invention, a concrete screed rail is provided having at least substantially parallel spaced top and bottom edges with a web portion between the edges, at least the upper edge being provided with a finished surface. A reinforcement is provided within the web portion, there being at least one recess in the web portion, with the reinforcement extending across the recess forming a thin layer of reinforced concrete. Preferably, a plurality of recesses are provided, across each of which a thin layer of reinforced concrete extends The reinforcement can be provided by a mesh or a plurality of short fibers.

The thin Layer of concrete reinforced with mesh or fibers extending across each recess is supported by the reinforcement, but can be knocked out as required to allow transverse reinforcement bars to extend through the recesses.

The screed rail may be in the form of a straight beam of I-section, or alternatively of generally L-shaped cross-section. Beams of L-shaped section are particularly suited to provide a border or edge regions of the slab.

If desired, additional reinforcement is incorporated in the rail, and a small aperture may be provided in each web portion separating each recess.

BRIEF DESCRIPTION OF THE DRAWING

Several screed rails in accordance with the present invention are now described by way of example with reference to the accompanying drawings, in which:

FIGS. 1–5 illustrate embodiments of the parent application, Ser. No. 185,834, filed Apr. 25, 1988.

FIG. 1 is a side elevation of a first embodiment of mesh reinforced rail;

FIG. 2 is a elevation of the rail of FIG. 1;

FIG. 3 is a perspective view of an alternative embodiment of mesh reinforced rail, showing how reinforcement bars can easily be used with it;

FIG. 4 is a perspective view of another alternative embodiment of mesh reinforced rail;

FIG. 5 is a section on the line V—V of FIG. 4, to an enlarged scale, through the rail of FIG. 4.

FIG. 6 is a side elevation of a first embodiment of fiber reinforced rail;

FIG. 7 is an end elevation of the rail of FIG. 6;

FIG. 8 is a perspective view of an alternative embodiment of fiber reinforced rail, showing how reinforcement bars can easily be used with it;

FIG. 9 is a perspective view of another alternative embodiment of fiber reinforced rail; and FIG. 10 is a section on the line X—X of FIG. 9, to an enlarged scale, through the rail of FIG. 9.

DESCRIPTION OF THE PREFERRED EMBODIMENTS

FIGS. 1–5 illustrate embodiments of the parent application, Ser. No. 185,834, filed Apr. 25, 1988.

In the various views, like parts are identified with the same reference numerals.

Referring to the drawings, each of the screed rails has a finished top edge 1, and in spaced, generally parallel relationship thereto, a bottom edge 3. Located between the top and bottom edge regions is a web portion 5. Since the screed rails are specifically designed to remain in situ in the poured concrete slab, the top edge 1 is finished smooth, and will be co-planar with the top surface of the slab.

Normally, in situ concrete slabs are poured in rectangular sections, and with the present invention, each section is defined by longitudinal screed rails and transverse stop ends. Central sections could be defined by a selection of any of the illustrated rails, but normally the same rails would be used. For an edge section however, the boundary edge of the section would normally be defined by one of the rails shown in FIGS. 4 and 5 or 9 and 10, with the flange 7 turned inwardly.

To use the rails, they are first placed in situ, and supported at the correct level on a few dabs of concrete, care being taken to ensure that the top edge 1 is set at the desired finished level of the slab. At the same time as the rails are being set in position, reinforcement bars, such as bars 9 and 11 shown in FIG. 3, are also placed in position as will hereinafter be explained. Then, the concrete can be poured into a rectangular space defined by the rails, and can be tamped or vibrated as necessary, using the aligned top edges of the rails as a levelling guide.

Referring now specifically to FIGS. 1 and 2, the rail shown therein is of inverted T-shaped cross-section, with an enlarged bottom flange 15, and a plurality of recesses 17 are provided in the web portion 5, spaced apart by portions of the web which are approximately of the same width as the top edge region of the rail. The whole rail is reinforced throughout its length by a strip of mesh reinforcement 19 extending between the top and bottom edge regions of the rail, this reinforcement being placed in the mold prior to casting of the concrete, so that in the finished rail, it is integral with the edge regions and web regions 5. Additional reinforcement bars or the like may be incorporated in the rail, such as the bars 21 and 23 shown in the embodiment of FIGS. 4 and 5.

The rail shown in FIG. 3 is a symmetrical rail with identical top and bottom edge regions, and provided both the top edge 1 and the bottom edge 3 are given a smooth finish, it can be used either way up. This rail is provided with cast in reinforcement restraining bars 13, but in place of these, apertures may be provided in the web portions between recesses 17.

The soreed rail shown in FIGS. 4 and 5 is specifically designed as an edge rail, and has an L-shaped cross-section. The mesh reinforcement 19 is shown adjacent one edge of the upstanding arm of the L-shaped rail, but could be centrally located. Its illustrated position in FIG. 5 is to allow room for the vertical arms of the L-shaped reinforcement bars 23 which extend through each web portion 5.

In all the constructions illustrated, a plurality of spaced recesses 17 with mesh reinforcement therein are illustrated. However, the shape and size of these recesses can be changed, and it is even envisaged that only a single long window in each rail would be provided. Furthermore pairs of vertically spaced windows could be provided. Such an arrangement could be very suited to deep webbed screed rails.

All the illustrated rails show the recesses 17 just with mesh reinforcement 19 extending across them. In practice, however, it is extremely difficult to cast the rails in this way, and it would be more usual for the recesses to be totally masked or "curtained" with a thin Layer or sheet of fine concrete supported by the reinforcement 19. In fact, this layer may be impossible to prevent during manufacture of the rails, especially if the concrete from which they are cast is over-vibrated. There is an advantage in having the mesh reinforcement masked, i.e. layer apertures therein filled in with a thin layer of concrete as this ensures no escape of "fat", e.g. concrete fines, from the poured slab when it is being tamped or vibrated. Clearly, the concrete layer is particularly advantageous in the edge rail shown in FIGS. 4 and 5, since it ensures a smooth edge finish to the concrete slab.

Such a concrete layer preferably is provided and is sufficiently thin not to impede the placing of the reinforcement rods. They are simply pushed through the Layer. It will thus be appreciated that the desired arrangement of reinforcement rods 9, 13 can be "threaded" in position to unite different pours, the "meshed" recess(es) offering a wide choice of location for each rod 9 and helping also to support it. If a rod 9 is too large to fit through one of the apertures in the mesh, the mesh can be snipped in the desired area with wire cutters to make a larger aperture.

Referring now specifically to FIGS. 6 and 7, a fiber reinforced rail is designated generally by the reference numeral 100. The rail 100 is of inverted T-shaped cross-section with an enlarged bottom flange 102. A plurality of recesses 104 are provided in a web portion 106, spaced apart by portions of the web 106 which are approximately of the same width as the top edge region of the rail. The whole rail is reinforced throughout its length by a plurality of short fibers. These may be formed of polypropylene and may be about 12 mm long, and mixed in with the other constituents of the concrete. Two suitable mixes of fibers are those sold as DOLANIT by Hoechst Chemicals and FIBREMESH by Fibremesh Limited of Chesterfield, and a suitable concrete mix is made up as follows:

One part by weight ordinary Portland cement
From 0.002 to 0.02 parts by weight fibers
One part by weight sand
Two parts by weight aggregate
0.5 part by weight water
plus the usual additives (water disperser, hardener, plasticiser).

Normally, from about 1 kg to 10 kg of fibers would be used in a cubic meter of concrete.

By way of such a mix, it is found that it can be turned out of the mold within 10–15 minutes of being poured and vibrated. Wetter mixes must be left for many hours before turning out.

Additional reinforcement bars or the like may be incorporated in a rail 100', such as bars 108 and 110 shown in the embodiment of FIGS. 9 and 10.

A rail 100" shown in FIG. 8 is a symmetrical rail with identical top and bottom edge regions, provided with both a top edge 112 and a bottom edge 114 having a smooth finish, so the rail 100" can be utilized with either edge 112 or 114. The rail 100" is provided with cast in reinforcement restraining bars 116, but in place of these, apertures (not illustrated), may be provided in the web portions between the recesses 104.

The screed rail 100' shown in FIGS. 9 and 10 is specifically designed as an edge rail, and has an L-shaped cross-section. The L-shaped reinforcement bars 110 extend through each web portion 106.

In all the constructions illustrated, a plurality of spaced recesses 104 with fiber reinforced thin concrete membranes 118 therein are illustrated. However, the shape and size of these recesses can be changed, and it is even envisaged that pairs of vertically spaced windows could be provided. Such an arrangement could be very suited to deep webbed screed rails.

In all constructions, the recesses are totally masked or "curtained" with the thin layer or membrane 118 of fiber reinforced concrete. This ensures no escape of "fat", e.g. concrete fines, from the poured slab when it is being tamped or vibrated. Clearly, this is important in the edge rail 100' shown in FIGS. 9 and 10, since it ensures a smooth edge finish to the concrete slab.

The fiber reinforced concrete membrane(s) 118 is/are sufficiently thin not to impede the placing of the reinforcement rods. They are simply pushed through the membrane 118. It will thus be appreciated that the desired arrangement of reinforcement rods 120, 116 can be "threaded" in position to unite different pours, the membraned recess(es) offering a wide choice of location for each rod 120 and helping also to support it.

From the foregoing, it wiII be appreciated that the present invention provides pre-cast concrete screed rails which are designed to improve the placing of in situ concrete slabbing and associated reinforcement. The rails are designed to become an integrated part of the whole slab, and give an improved edge finish to a completed floor. The rails may be of any desired length, e.g. 3 meters, and in various heights. Ideally, the rail has recesses 17 or 104 at 300 mm centers covering the significant face area of the web form, to allow the free passage of reinforcement, dowels and conduit of varying sizes, but still retain the fresh concrete during pouring or placing.

Furthermore, the mesh or concrete membrane filled recesses also allow full bond area to any connecting reinforcement passing through. This eliminates problems associated with bars passing through holes as in known concrete screed rails where full compaction is not achieved around the holes, thus weakening the finished product. Freedom of design is available to the engineer to place all reinforcement and services passing through concrete joints at their required position.

The use of the rail provides superior concrete material at the edges of slabs, eliminating problems sometimes associated with poorly placed concrete in this area.

The rail would normally be constructed of 40 $MN/MM^2$ concrete, reinforced with X MM HT wire and with the mesh or fiber reinforcement located throughout the unit, thus providing crack control as well as performing its other function of supporting the concrete membranes 19 or 118 in the recesses 17 or 104. Being of pre-cast concrete, there is improved quality control, and as a result, a product can be achieved which is constant in line and section, as written into a contract, being of particular benefit where super flat floors are required.

When shimmed to level and secured in line by dabs of wet concrete, the rail will provide a secure form for tamping and screeding in both longitudinal and transverse joints or finished edges, giving the contractor complete control over the work without having to puncture any sub-surface membrane.

The largest rail would normally weigh approximately 30 kg making it easy for one operator to fix. When compared to traditional methods, the savings in time in setting up and stripping out are approximately 50%, thus speeding the work on the whole project.

Furthermore, rails such as those shown in FIGS. 4 and 5 or 9 and 10 can be used back to back with expansion jointing material incorporated between them. This ensures that these joints are properly constructed and that both edges are sound.

A further advantage of the screed rails of the present invention is that, because of the recesses, they require about 20% less concrete for their manufacture than known concrete screed rails. This means they are easier to use. Also, there tends to be less grout loss than occurs with traditional stop-end shuttering.

In the course of construction, the rails are used as screed rails. However, in the finished work, a superior edge finish is obtained, which is particularly advantageous where high wheel loadings can be expected on slab edges and joints. Also, the rails can be used to form construction, isolation, slab edge, expansion or contracting joints. Thus, the rails also provide a comprehensive jointing for concrete slabs.

Instead of using a standard ferrous steel reinforcing rod in the top edge region of the screed rail (such as the rods 21 or 108 shown respectfully in FIGS. 5 and 10), it is preferred to use a helically wound stainless steel rectangular bar having a cross-sectional dimension of approximately 7 mm×1 mm and a helix pitch of about 15 mm. Such reinforcing bars are manufactured by Helix Reinforcements Limited and do not rust. When utilizing the steel mesh filled recesses, it also is preferred to incorporate the fibers in the mesh to further increase impact resistance in the screed rails. Because the fibers are incorporated in the concrete mix, impact resistance is increased in the fiber reinforced screed rails. It is also preferred that sharp corners are rounded off on the screed rail and a radiused edge be provided to the underside of the top edge portion to allow the release of entrapped air in the recesses during manufacture of the screed rails.

Modifications and variations of the present invention are possible in light of the above teachings. It is therefore to be understood that within the scope of the appended claims, the invention may be practiced otherwise than as specifically described.

What is claimed and desired to be secured by Letters Patent of the United States is:

1. A concrete screed rail having at least substantially parallel spaced top and bottom edges with a web portion extending between said edges, a smooth finished surface being provided on at least said top edge, and including at least one recess provided in said web portion, including reinforcement means cast within said web portion, said reinforcement means extending across said recess and having a thin layer of fine concrete including said reinforcement means extending across said recess cast with said reinforcement means.

2. The concrete screed rail according to claim 1 wherein a plurality of recesses are provided, across which said reinforcement means extends, spaced apart by web portions.

3. The concrete screed rail according to claim 1, which is in the form of a straight beam of I-section.

4. The concrete screed rail according to claim 1 wherein additional reinforcement is incorporated in said rail.

5. The concrete screed rail according to claim 1 wherein a small aperture is provided in each web portion.

6. The concrete screed rail according to claim 1 including a helically wound rectangular stainless steel reinforcing rod located in an upper edge region of the rail.

7. The concrete screed rail according to claim 1 which is fabricated from a concrete mix in which short fibers are incorporated.

8. The concrete screed rail according to claim 1 wherein the rail is of generally L-shaped cross-section.

9. The concrete screed rail according to claim 8 wherein said reinforcement means are located adjacent an external face of said rail.

10. The concrete screed rail according to claim 1 wherein said reinforcement means include a mesh reinforcement.

11. The concrete screed rail according to claim 10 wherein said reinforcement means also include a plurality of short fibers.

12. The concrete screed rail according to claim 1 wherein said reinforcement means include a plurality of short fibers.

13. The concrete screed rail according to claim 12 wherein said short fibers are formed of polypropylene and are about 12 mm long.

14. The concrete screed rail according to claim 12 wherein from 0.002 to 0.02 part by weight of said short fibers are incorporated in a concrete mix including one part by weight of ordinary Portland cement, one part by weight of sand, two parts by weight of aggregate and 0.5 parts by weight of water.

15. The concrete screed rail according to claim 12 wherein a plurality of recesses are provided, across which a thin layer of fiber reinforced concrete extends.

16. The concrete screed rail according to claim 15 wherein said thin layer of fiber reinforced concrete extending across each said recess is supported by said fiber reinforcement but can be knocked out as required to allow transverse reinforcement bars to extend through said recesses.

* * * * *